252-105 AU 166 EX
10/14/80 XR 4,227,881

United States Patent [19]
Fono

[11] 4,227,881
[45] Oct. 14, 1980

[54] NEW PROCESS OF COLOR STRIPPING DYED TEXTILE FABRIC

[75] Inventor: Andrew Fono, Montclair, N.J.

[73] Assignee: Royce Chemical Company, East Rutherford, N.J.

[21] Appl. No.: 961,728

[22] Filed: Nov. 17, 1978

[51] Int. Cl.[2] ..... D06L 3/00
[52] U.S. Cl. ..... 8/102; 8/461; 252/105
[58] Field of Search ..... 8/102, 69; 252/105

[56] References Cited

U.S. PATENT DOCUMENTS 2,985,500 5/1961 Janson et al. ..... 8/102
3,591,325 7/1971 Sapers ..... 8/102

OTHER PUBLICATIONS

Chavan, Stripping of Dyestuffs from Textiles, Silk and Rayon Industries of India, Feb. 1969, pp. 167–170.

*Primary Examiner*—Melvyn I. Marquis
*Attorney, Agent, or Firm*—Brumbaugh, Graves, Donohue & Raymond

[57] ABSTRACT

The specification describes an improved aqueous stripping liquid and process for stripping dyes from textile fabric which comprises treating fabric in a heated aqueous solution of sodium hydroxymethane sulfinate, ammonium cations and sulfite anions.

15 Claims, No Drawings

NEW PROCESS OF COLOR STRIPPING DYED TEXTILE FABRIC

BACKGROUND OF THE INVENTION

In dyeing textile fabric, it is often desirable to remove the color from the dyed fabric in order to correct faulty dyeing or to redye surplus fabric to a different color for reuse. Stripping is the process which is used to remove dye from dyed fabrics, and the process is either designated "back stripping" or "destructive stripping". In back stripping, only the depth of shade is changed while in destructive stripping, the dye is chemically altered. For example, dyes containing an azo group (—N=N—) can be chemically reduced to an almost colorless amine compound by using chemical reducing agents.

It is important that the stripping process, whether back or destructive stripping, effectively and efficiently remove the dye without damping the fabric and without leaving a residue which would affect subsequent redyeing of the fabric. Textile fabrics are commonly stripped using various stripping liquids. Stripping liquids usually contain a combination of a chemical reducing agent and a stripping assistant. Stripping assistants are chemicals for improving the stripping ability of reducing agent. Some of the stripping assistants known to be used in prior art stripping liquids are quaternary ammonium salts, formic acids, and benzyl alcohol. For example see "Stripping of Dyestuffs From Textiles", by R. B. Chavan *Silk and Rayon Industries of India,* February, 1969, pp. 167—170, and U.S. Pat. No. 3,591,325 to Sapers both of which are incorporated herein by reference.

In the past, various chemical combinations of reducing agents and stripping assistants have been used in stripping liquids in order to strip dyes from textile fabrics. Direct dyes are stripped by boiling the fabric in alkaline sodium hydrosulfite or by bleaching the fabric with sodium hypochlorite or by boiling the fabric with 1-2% sodium chlorite adjusted with formic or acetic acid to a pH of 3 to 4. Vat dyes are stripped by treating fabric in a heated reducing bath containing sodium hydroxide, sodium dithionite and a substance which acts to combine with the dye in order that it does not recombine with the textile material once it is reduced. Vat dyes are also stripped from fabric by treatment of fabric with a stripping liquid containing caustic soda, sodium hydrosulfite and a quaternary ammonium salt. Sulphur dyes are stripped from fabrics with hot solutions of soda ash and sodium sulphide. Dispersed dyes can be removed from fabric with hot solutions of sodium hydrosulfite and ammonium hydroxide or zinc sulphoxylate formaldehyde and formic acid or sodium chlorite and formic acid. Most dyes can be stripped from polyester fabric with sodium hydroxymethane sulfinate in the presence of a carrier and acetic acid. These methods of stripping dyed fabric are disclosed in "Stripping of Dyestuffs from Textiles", by R. B. Chavan, *Silk and Rayon Industries of India,* February, 1969, pp. 167-170, and U.S. Pat. No. 3,591,325 to Sapers, both of which are incorporated herein by reference.

None of the various stripping liquids described in the prior art has had universal acceptance in the fabric dyeing industry. None of the stripping liquids could be used on a variety of fabrics and dyes; rather the stripping liquids had to be individually designed depending on the fabric and the dye being removed. In addition, many of the prior art stripping liquids had a pH greater than 9 which could have a harmful affect on some fabrics. These strong alkaline stripping liquids were used in order to break the bond of the dye to the fabric, but often left a stripped fabric which was difficult to redye successfully.

SUMMARY OF THE INVENTION

It has now been discovered that by using the critical combination of sodium hydroxymethane sulfinate, an ammonium salt and a sulfite salt in an aqueous stripping liquid having a pH of from about 5 to 9 a variety of fabric substantive dyes can be stripped from a variety of fabrics using a temperature of at least about 140° F.

Thus, in accordance with the preferred embodiment of the invention, ammonium and sulfite salts are dissolved in water in a suitable container to form ammonium cations and sulfite anions. The solution is heated to a temperature of at least about 140° F. Sodium hydroxymethane sulfinate is added to the heated salt solution to form a stripping liquid, and the textile fabric to be stripped is placed in the heated stripping liquid. The stripped fabric is removed from the stripping liquid and rinsed with water.

DETAILED DESCRIPTION OF THE INVENTION

The present invention is suitable for stripping dye from textile fabrics using stripping liquid having a pH no higher than a pH of about 9 and with a reduction in the amount of reducing agent required to remove the dye. The term dye includes, without limitation, all reactive, direct vat, acid, pre-metalized, azo, cationic and basic dyes and mixtures thereof. The term textile fabric includes, without limitation, all fabrics and yarns containing cotton fibers, synthetic or other fibers, such as rayon, polyester, acetate and polyacrylonitrile fibers and all blends made from these fibers. The term covers any yarn, rawstock or fibers, or any such fabric whether woven or knitted.

In the present invention, the stripping liquid is prepared by dissolving sodium hydroxymethane sulfinate and ammonium and sulfite salts in heated water to form ammonium cations and sulfite anions. Preferably, the stripping liquid is prepared by adding sodium hydroxymethane sulfinate to a container in which ammonium and sulfite salts have been dissolved in heated water to provide ammonium cations and sulfite anions. It is believed that the presence of ammonium cations and sulfite anions in the stripping liquid enhance the stripping ability of the sodium hydroxymethane sulfinate. The stripping liquid contains about 1% to 3.5% of each salt based on the weight of the fabric to be stripped and preferably about 1% to 2% of each salt.

The source of ammonium cations can be any suitable ammonium salt. Suitable ammonium salts, without limitation, are ammonium sulfate, ammonium chloride, ammonium carbonate, ammonium bicarbonate, organic ammonium salts, such as ammonium acetate, ammonium formate, ammonium citrate, and mixtures thereof. In the preferred embodiment of this invention, the ammonium salt is ammonium sulfate.

The source of the sulfite anions can be a suitable sulfite salt. Suitable sufiltes, without limitation, are sodium sulfite, sodium bisulfite, calcium bisulfite, potassium sulfite, and mixtures thereof. In the preferred embodiment of this invention, the sulfite is sodium sulfite.

The reducing agent used in the stripping liquid of this invention is sodium hydroxymethane sulfinate. It is generally used in the range of about 0.5% to 3.5% based on the weight of the fabric to be stripped. Preferably about 0.5% to 2% sodium hydroxymethane sulfinate is used.

Alternatively, the aqueous stripping liquid of this invention also contains about 0.05% to 2.0% of a wetting agent based on the weight of the fabric used, preferably about 0.2% wetting agent is used. Wetting agent, as defined herein, is a water soluble surfactant. Suitable wetting agents, without limitation, are sulfonated and phosphated anionic wetting agents, long-chain phosphate alcohols and oxyethylated non-ionic wetting agents. In the preferred embodiment, the wetting agent is a long-chain phosphate alcohol.

In preparing the stripping liquid in the preferred embodiment sodium hydroxymethane sulfinate is added to a container in which ammonium and sulfite salts have been dissolved in heated water to give ammonium cations and sulfite anions. The solution of ammonium cations and sulfite anions are usually maintained at a temperature from about 140° F. to 190° F., but preferably from about 160° F. to 190° F. The sodium hydroxymethane sulfinate, the wetting agent and the fabric to be stripped are added to the heated solution of ammonium cations and sulfite anions and the resulting stripping liquid is held at a constant temperature for about 30 to 60 minutes.

After treatment of the fabric in the stripping liquid, the stripped fabric is removed, rinsed with hot water containing 0 to 0.2% of a soap or detergent such as a stearate, phosphate or alcohol sulfonate to remove excess dye and stripping liquid. The stripped fabric is then dried in an oven or on a drum dryer.

In an alternate embodiment of the invention after the fabric is added to the stripping liquid, the temperature of the stripping liquid is increased immediately from its initial temperature over a 30 minute period and then held constant at a higher temperature for an additional 30 minutes. For example, if the initial temperature is 160° F., the temperature of the stripping liquid is increased immediately to 190° F. over a 30 minute time period and then maintained at 190° F. for an additional 30 minutes. After treatment of the fabric in the stripping liquid, the stripped fabric is removed and treated as heretofore described.

Using the stripping process of the present invention, a variety of fabric substantive dyes can be evenly and efficiently stripped from a variety of fabrics using a pH from 5 to 9 without causing any significant harm to the fabric and without leaving dulling effects from residual color which remains in the fabric. For example, direct dyes can be removed from cellulose polyester blend fabrics, acid dyes can be successfully stripped from nylon fabric and much of the dye can be removed from polyester fabrics. In the past, dye has been difficult to remove from acrylic fabrics using a conventional reducing agent, but the process of the present invention has been proven successful in the stripping of basic dyes from acrylic fabric. The process of the present invention has also been effective in stripping vat dyes if a dye-complexing carrier such as polyvinyl pyrrolidone is used to keep the dye from recombining with the fabric fibers once it is stripped.

The amount of sodium hydroxymethane sulfinate used in the stripping liquid of the present invention is about ⅓ to ½ of the amount of reducing agent used in the prior art stripping liquids. The stripping liquid of the present invention, however, produces significantly more efficient stripping than a conventional stripping liquid using larger amounts of reducing agent. This decrease in the amount of reducing agent, for example sodium hydroxymethane sulfinate, used in stripping fabrics is helpful since it decreases the amount of reducing agent being discharged in the dye effluent. This is important to the dye industry since a decrease in the amount of reducing agents in the effluent decreases the chemical oxygen demand of the dye waste water which makes the waste water less harmful to the environment.

The degree of stripping achieved in a piece of fabric is judged by the depth of color remaining in the stripped fabric. The depth of color in the dyed fabric before stripping is assigned a color depth of 100. The color depth of a white, undyed fabric piece is assigned a color depth of 0. The fabric after stripping is assigned a color depth from 0 to 100 to indicate the percent of dye remaining in the fabric as determined by visually comparing it to the unstripped fabric (100) and the white undyed fabric (0).

If, in addition to a change in the depth of color, there is a shift in the color shade remaining in the stripped fabric, a shade change value is assigned. If the shift is towards green, the sample is rated G, towards yellow, Y, and towards red, R. The degree of the shade change is graded from 1 to 5 depending on the intensity of the color shift. The value 1 representing a slight shift and a value of 5 indicates a very strong color shift.

Fabrics stripped according to this invention have remaining color depths of from 10 to 40 and showed little or no shift in the color shade of the color remaining in the stripped fabric.

The following examples are submitted to illustrate but not to limit the invention. All percentages in the specification and claims are based on the weight of the piece of fabric being stripped. Examples 6, 7, 8, 10, 12, 14, 15, 17, 18, 19, 20 illustrate the invention and the superior stripping results achieved through its use. Examples 1–5 and 9, 11, 13, 16 illustrate conditions outside the invention.

Ten gram skeins of fibers were used in all examples. The results from examples 1–9, are summarized in Table I. Examples 6–8 illustrate the superior stripping ability of stripping liquid of the invention as compared with other stripping liquids.

TABLE I

| Stripping liquid | Examples | | | | | | | | |
|---|---|---|---|---|---|---|---|---|---|
| (grams) | 1 | 2 | 3 | 4 | 5 | 6 | 7 | 8 | 9 |
| sodium dithionite | 0.4 | — | — | — | — | — | — | — | — |
| sodium hydroxymethane sulfinate | — | 0.3 | 0.2 | 0.2 | 0.35 | 0.05 | 0.1 | 0.2 | — |
| sodium hydroxide | 0.5 | — | — | — | — | — | — | — | — |
| ammonium sulfate | — | — | — | 0.6 | — | 0.1 | 0.1 | 0.2 | 0.25 |
| sodium sulfite | — | — | — | — | 0.6 | 0.1 | 0.1 | 0.2 | 0.25 |
| color depth | 20 | 15 | 20 | 15 | 15 | 15 | 5 | 0 | 95 |
| shade change | 5Y | 4G | 4G | 4G | 4G | 0 | 0 | 0 | 1Y |

EXAMPLE I

A beaker was filed with 200 milliliters of water and heated to 140° F. The temperature was maintained at 140° F. and 0.02 g SUPERWET*, 0.4 g sodium dithionite and 0.5 g sodium hydroxide were added. A 10 g skein which had been dyed brown using 0.55% Solophenyl Yellow 2 GL powder (Direct Yellow 39) of Ciba Geigy, 1.28% Solantine Brown BRL paste (Direct Brown 95) of Allied Chemical, 0.51% Solantine Blue 4 GL (150%) (Direct Blue 78) of Allied Chemical was added to the stripping liquid. The stripping liquid was maintained at 140° F. for 1 hour. The skein was removed, rinsed with hot water containing 0.05% soap and compared to a unstripped skein. The stripped skein was judged to have a color depth of 20 and a shade change of 5 Y.

*SUPERWET is a long-chain phosphate alcohol supplied by Royce Chemical Company

EXAMPLE 2

A beaker was filed with 200 ml of water and heated to 160° F. The temperature was maintained at 160° F. and 0.02 g SUPERWET and 0.3 g of sodium hydroxymethane sulfinate were added to the stripping liquid. A 10 g skein which had been dyed brown as in Example 1 was added to the stripping liquid. The temperature of the stripping liquid was increased to 190° F. over 30 minutes and maintained at 190° F. for an additional 30 minutes. The skein was removed, rinsed with hot water containing 0.05% soap and compared to an unstripped skein. The stripped skein was judged to have a color depth of 15 and a shade change of 4 G.

EXAMPLE 3

The procedure of Example 2 was repeated except that 0.2 grams of sodium hydroxymethane sulfinate was added to the stripping liquid. The stripped skein was judged to have a color depth of 20 and a shade change of 4 G.

EXAMPLE 4

The procedure of Example 2 was repeated except that 0.6 g ammonium sulfate were added to the water before it was heated and 0.2 g of sodium hydroxymethane sulfinate were added to the stripping liquid. The stripped skein was judged to have a color depth of 15 and shade change of 4 G.

EXAMPLE 5

The procedure of Example 2 was repeated except that 0.6 g sodium sulfite was added to the water before it was heated and 0.35 g sodium hydroxymethane sulfinate was added to the stripping liquid. The stripped skein was judged to have a color depth of 15 and a shade change of 4 R.

EXAMPLE 6

The procedure of Example 2 was repeated except that 0.1 g ammonium sulfate and 0.1 g sodium sulfite were added to the water before it was heated and 0.05 g of sodium hydroxymethane sulfinate were added to the stripping liquid. The stripped skein was judged to have a color depth of 15 and there was no shade change.

EXAMPLE 7

The procedure of Example 6 was repeated except that 0.1 g of sodium hydroxymethane sulfinate, 0.1 g ammonium sulfate and 0.1 g sodium sulfite were used. The stripped skein was judged to have a color depth of 5 and no shade change.

EXAMPLE 8

The procedure of Example 6 was repeated except that 0.2 g sodium hydroxymethane sulfinate, 0.2 g ammonium sulfate and 0.2 g sodium sulfite were added to the stripping liquid. The stripped skein was judged to have a color depth of 0 with no shade change.

EXAMPLE 9

The procedure of Example 1 was repeated except that 0.25 g ammonium sulfate and 0.25 g sodium sulfite were added to the water instead of sodium dithionite and sodium hydroxide before it was heated. The stripped skein was judged to have a color depth of 95 and a shade change of 1 Y.

The above examples show the superior results achieved with the process of this invention. Examples 6, 7 and 8 illustrate the invention. Example 8 shows complete stripping with no color change using 2% sodium hydroxymethane sulfinate, 2% sodium sulfite and 2% ammonium sulfate. Examples 6 and 7 illustrate, however, that acceptable stripping with no shade change can be achieved using as little as 0.5–1% sodium hydroxymethane sulfinate and 1% ammonium sulfate and 1% sodium sulfite.

Example 1 demonstrates a prior art stripping liquid using sodium dithionite and sodium hydroxide. Twenty percent of the color remains and there was a strong color shift to yellow. Examples 2 and 3 show the results outside the invention using sodium hydroxymethane sulfinate alone. The fabric exhibited a shade change to green and 15% to 20% of the color remained. Example 4 shows the stripping results outside the invention when ammonium sulfate alone is added to sodium hydroxymethane sulfinate. This fabric also exhibited a strong shade change to green and 15% of the color remained. Example 5 shows the result outside the invention of using sodium sulfite alone in combination with sodium hydroxymethane sulfinate. In this example the shade change was to red. Example 9 shows that without the use of sodium hydroxymethane sulfinate the combination of even 2.5% ammonium sulfate and 2.5% sodium sulfite results in almost no stripping of the dye.

The following examples further demonstrate the effectiveness of the claimed process on various fabrics and dyes as compared to some prior art stripping liquids.

EXAMPLE 10

A beaker was filled with 200 ml of water and 0.15 g sodium sulfite and 0.15 g ammonium sulfate were added. The solution was heated to 160° F. The temperature was maintained at 160° F. and 0.15 g sodium hydroxymethane sulfinate and 0.02 g SUPERWET were added to the stripping liquid. A 10 g cotton skein, which has been dyed yellow using 0.60% Diphenyl Yellow RLSW (Direct Yellow 50) of Ciba Giegy and 0.13% Diphenyl Orange 4G (Direct Yellow 72) of Ciba Giegy, was added to the stripping liquid. The stripping liquid was heated to 190° F. over a 30 minute period, then held constant at 190° F. for an additional 30 minutes. The skein was removed, rinsed with hot water containing 0.05% soap and compared to an unstripped sample. The stripped skein was judged to have a color depth of 0 and no shade change.

EXAMPLE 11

A beaker was filled with 200 ml of water and heated to 190° F. and 0.02 g SUPERWET, 0.5 g trichlorobenzene carrier and 0.2 sodium hydroxymethane sulfinate were added. A 10 g polyester skein, which had been dyed deep black using 5.0% Amacron Black K a commercial blend of azo dyes of American Color, and 0.4% Amacron Navy Blue AR a commercial azo blue of American Color, was added to the stripping liquid. The stripping liquid was maintained at 190° F. for 30 minutes. The skein was removed, rinsed with hot water containing 0.05% soap and compared to an unstripped sample. The stripped skein was judged to have a color depth of 50.

EXAMPLE 12

The procedure of Example 11 was repeated but in addition to the carrier and sodium hydroxymethane sulfinate, 0.2 grams ammonium sulfate and 0.2 grams sodium sulfite were added to the water before it was heated. The stripped skein had a color depth of 30 and no shade change.

A comparison of the results from Example 11 which is outside the invention and those of Example 12 which is within the invention show that superior stripping results are obtained using the critical combination of sodium hydroxymethane sulfinate, ammonium sulfate and sodium sulfite to strip polyester skeins.

EXAMPLE 13

A beaker was filled with 200 ml of water and heated to 140° F. The temperature was maintained at 140° F. and 0.02 g SUPERWET and 0.4 g sodium hydroxide and 0.4 g sodium dithionite were added. A 10 g cotton skein, which had been dyed red using 4.00% Rhodazol Scarlet 3G (Reactive Red 94) of American Hoechst, 2.45% Remazol Rd FB Powder (Reactive Red 104) of American Hoechst, and 1.0% Remazol Orange 3R (Reactive Orange 16) of American Hoechst was added to the stripping liquid. The temperature was maintained at 140° F. for one hour and the skein was removed, rinsed with hot water containing 0.05% soap and compared to an unstripped skein. The stripped skein was judged to have a color depth of 15 and a shade change of 4 Y.

EXAMPLE 14

The procedure of Example 13 was repeated but instead of sodium dithionite and hydroxide, 0.2 g ammonium sulfate, 0.2 g sodium sulfite were added to the water before it was heated to 160° F. After heating to 160° F. 0.2 g sodium hydroxymethane sulfinate were added to the stripping liquid. The stripping liquid was heated to 190° F. over a 30 minute period then maintained at 190° F. for an additional 30 minutes. The skein was removed, rinsed with hot water containing 0.05% soap and compared to an unstripped skein. The stripped skein was judged to have a color depth of less than 5 and shade change of 1 Y.

A comparison of the results from Example 13 which is outside the invention and those from sample 14 which is within the invention show that superior stripping results are obtained using the critical combination of sodium hydroxymethane sulfinate, ammonium sulfate and sodium sulfite for stripping cotton skeins.

EXAMPLE 15

A beaker was filled with 200 ml of water and 0.15 g ammonium sulfate and 0.15 g sodium sulfite were added and heated to 190° F. The temperature was maintained at 190° F. and 0.02 g SUPERWET and 0.15 g sodium hydroxymethane sulfinate were added. A 10 g nylon skein, which has been dyed olive using 0.4% Amalon Yellow 4 GP power (Acid Yellow 174) of American Color, 0.033% Amalon Red BV power (Acid Red 151) of American Color, 0.26% Alizan Fast Blue AP powder (Acid Blue 25) of Atlantic Color, was added to the stripped liquid. The stripped liquid was maintained at 190° F. for 30 minutes. The skein was removed, rinsed with hot water containing 0.05% soap and compared to an unstripped skein. The stripped skein was judged to have a color depth of 10.

EXAMPLE 16

A beaker was filled with 200 ml of water and heated to 190° F. The temperature was maintained at 190° F. and 0.02 gram SUPERWET and 0.35 g sodium hydroxymethane sulfinate were added. A 10 g acrylic skein which had been dyed to a deep black using 3.0% Calcozine Black MD of American Cyanamid, 0.1% Calcozine Fuchsin RTN of American Cyanamid, was added to the stripping liquid. The stripping liquid was maintained at 190° F. The skein was removed, rinsed in hot water containing 0.05% soap and compared to an unstripped skein. The stripped skein was judged to have a color depth of 70.

EXAMPLE 17

The procedure of Example 16 was repeated except that 0.35 gram sodium hydroxymethane sulfinate and ammonium sulfate and 0.35 gram sodium sulfite were added to the stripping liquid. The stripped skein was judged to have a color depth of 40.

This represents a degree of stripping which could not be achieved using any of the prior art methods. A comparison of the results from Example 16 which is outside the invention and those of Example 17 which is within the invention, shows that superior stripping results are obtained using the critical combination of sodium hydroxymethane sulfinate, ammonium sulfate and sodium sulfite to strip acrylic skeins.

EXAMPLE 18

A beaker was filled with 200 ml of water and 0.2 g ammonium sulfate and 0.2 sodium sulfite were added and heated to 190° F. The temperature was maintained at 190° F. and 0.02 gram SUPERWET, and 0.2 g sodium hydroxymethane sulfinate and 0.2 gram Pergal ST a polymer of General Aniline & Film Corp. capable of forming insoluble salts with reduced vat dye were added. A 10 gram cotton skein, which had been dyed to an olive shade using 5.0% Ponsol Olive T (Vat Black 25 of DuPont), was added to the stripping liquid. The stripping liquid was maintained at 190° F. for 30 minutes.

The skein was removed, rinsed with hot water containing 0.05% soap and compared to an unstripped sample. The stripped skein was judged to have a color depth of 30.

EXAMPLE 19

A beaker was filled with 200 ml of water, and 0.2 g ammonium sulfate and 0.2 g sodium sulfite were added and heated to 160° F. The temperature was maintained at 160° F. and 0.02 g SUPERWET and 0.2 g sodium hydroxymethane sulfinate were added. A 10 gram 50% polyester 50% cotton skein, which had been dyed blue using 1.40% Palanil Navy Blue RD, (Disperse Blue 94 of Badishe Aniline), 0.08% Foron Rubine SE GFL, (Disperse Red 73 of Sandoz), 0.4% Foron Yellow SE SOW, (Disperse Yellow 42 of Sandoz), 1.00% Rhodazol Dark Blue 2BLA Powder, (Reactive Blue 89 of American Hoechst), 0.05 Rhodazol Brilliant Violet 4B a propiertary reactive dye from Americant Hoechst, 0.75% Rhodazol Navy Blue GX, a propietary reactive dye of American Hoechst, was added to the stripping liquid. The stripping liquid was heated to 190° F. over a 30 minute period and then heat at 190° F. for an additional 30 minutes. The skein was removed, rinsed with hot water containing 0.05% soap and compared to an unstripped skein. The stripped skein was judged to have a color depth of 40.

While specific embodiments of the invention have been described, it will be understood that other materials may in many instances be substituted and the inventions should be construed as limited only by the scope of the appended claims.

We claim:

1. A composition for stripping dye from textile fabric which comprises an aqueous solution of about 0.5% to 3.5% sodium hydroxymethane sulfinate, about 1% to 3.5% of a ammonium salt and about 1% to 3.5% of a sulfite salt maintained at a temperature of at least about 140° F. and having a pH of from about 5 to 9.

2. A composition according to claim 1 which is maintained at a temperature from about 140° F. to 190° F.

3. A composition according to claim 1 wherein the ammonium salt is selected from the group consisting of ammonium sulfate, ammonium chloride, ammonium carbonate, ammonium bicarbonate, an organic ammonium salt and mixtures thereof.

4. A composition according to claim 1 wherein the sulfite salt is selected from the group consisting of sodium sulfite, sodium bisulfite, calcium bisulfite, potassium sulfite and mixtures thereof.

5. A composition according to claim 1 wherein about 0.2% of a long-chain phosphate alcohol is added as a wetting agent.

6. A process for stripping dye from textile fabric which comprises preparing an aqueous stripping liquid containing about 1% to 3.5% of an ammonium salt about 1% to 3.5% of a sulfite salt and about 0.5% to 3.5% sodium hydroxymethane sulfinate heated to a temperature of at least about 140° F. and adding the fabric to the heated liquid which is maintained at a temperature of about 140° F. whereby the dye is stripped therefrom.

7. The process according to claim 6 wherein dyes selected from the group consisting of reactive, direct and vat dyes are stripped from cotton fabric.

8. The process according to claim 6 wherein dyes selected from the group consisting of acid, direct and disperse dyes are stripped from polyester fabric.

9. The process according to claim 6 wherein disperse dyes are stripped from polyester fabric.

10. The process according to claim 6 wherein premetalized dyes are stripped from nylon fabric.

11. The process according to claim 6 wherein basic dyes are stripped from acrylic fabric.

12. The process according to claim 6 wherein after the addition of the fabric, to the heated liquid the temperature of the stripping liquid is increased to about 190° F. over a 30 minute period and then maintained at about 190° F. for an additional 30 minutes.

13. The process according to claim 6 wherein the ammonium salt is selected from the group consisting of ammonium sulfate, ammonium chloride, ammonium carbonate, ammonium bicarbonate, an organic ammonium salt and mixtures thereof.

14. The process according to claim 6 wherein the sulfite salt is a sulfite selected from the group consisting of sodium sulfite, sodium bisulfite, calcium bisulfite, potassium sulfite and mixtures thereof.

15. A process for stripping dye from textile fabric which comprises preparing an aqueous stripping liquid containing about 1% to 3.5% of an ammonium salt and about 1% to 3.5% of a sulfite salt, heating the liquid to a temperature of at least about 140° F., adding about 0.5% to 3.5% sodium hydroxymethane sulfinate and adding the fabric to the heated liquid which is maintained at a temperature of about 140° F. whereby the dye is stripped therefrom.

* * * * *